US006793081B1

(12) United States Patent
Derman

(10) Patent No.: US 6,793,081 B1
(45) Date of Patent: Sep. 21, 2004

(54) LOCKING NECK RING

(76) Inventor: Jay S Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 10/612,508

(22) Filed: Jul. 3, 2003

(51) Int. Cl.[7] ..... B65D 55/02
(52) U.S. Cl. ..... 215/201; 215/280; 70/158
(58) Field of Search ..... 215/201, 202–225, 215/280, 282, 298, 290, 273; 710/158, 164, 171, 177, 180, 58, 77, 63, 14

(56) References Cited

U.S. PATENT DOCUMENTS 335,444 A * 2/1886 Guild ..... 215/283
609,974 A * 8/1898 Parsons et al. ..... 215/224
1,343,962 A * 6/1920 Byrne ..... 215/207
3,578,196 A * 5/1971 Ender ..... 215/207
3,593,549 A * 7/1971 Lakins et al. ..... 70/164
3,615,036 A * 10/1971 Mross ..... 220/210
3,782,604 A * 1/1974 Kessler ..... 215/220
5,586,670 A * 12/1996 Greenwald ..... 215/207
5,957,313 A * 9/1999 Bouan ..... 215/215
5,992,187 A * 11/1999 Derman ..... 70/58

* cited by examiner

*Primary Examiner*—Lien Ngo
(74) *Attorney, Agent, or Firm*—Monty Koslover

(57) ABSTRACT

A locking neck ring device that is placed over a capped bottle or container and grips the bottle neck ring, and together with a padlock or other securing means, prevents access to the bottle cap. The locking device comprises a clamp member that jackets a capped bottle neck; a cover which fits over the clamp member causing it to clamp on to the neck below the neck ring, and means to hold the clamp member to the cover. Provision is made for attaching a padlock or other securing means which holds the locking ring device in place. The bottle or container cap can then not be accessed for removal. The device is applicable to all sizes of drug containers, wine and liquor bottles for effectively locking access to the container contents.

5 Claims, 3 Drawing Sheets

LOCKING NECK RING

BACKGROUND OF THE INVENTION

1. Field of the Invention

This invention relates to bottles and other portable containers which have a ring around the neck, and more particularly to a means for locking containers to restrict unauthorized access to their contents.

2. Background

Medical prescription drug bottles used in pharmacies require security from unauthorized access. Usually, this means locking the area where these containers are stored, rather than locking individual containers. Persons, particularly those with small children, might also consider individually locking some prescription drug bottles. Often, safety requires that these bottles be locked when not in use.

If there is need to secure them, wine and liquor bottles would similarly have to be stored in a locked area. This solution is not practical in many households which do not have a suitable, lockable storage area. Since there may be instances where there is a need to prevent some individuals from having access to liquor or wine, a separate lock for each bottle or container would be helpful.

In view of the foregoing, there is a need for a simple, lockable cover that can be applied to portable bottles of various sizes, and together with an external lock, secure an individual bottle or container.

SUMMARY OF THE INVENTION

The invention device is a lockable cover for a bottle or container having a twist or press on cap, and neck ring below the threads. The device grips the bottle neck immediately below the neck ring and together with a padlock or other securing means, prevents access to the container cap and contents. The locking device comprises a clamp member that jackets a capped bottle neck; a cover which fits over the clamp member causing it to clamp on to the neck below the neck ring, and a bolt which holds the clamp member to the cover. A securing means such as a padlock can then be attached to the protruding end of the bolt, securing the locking neck ring device in place. When so locked, the bottle or container cap can not be accessed for removal.

The principal object of the present invention is to provide a lockable cover for a bottle or container which has a flanged ring around its neck and a twist or press on cap.

Another object of the invention is to provide a device that is simple in construction, has few parts and is economic to manufacture.

Further objects and advantages of the invention will be apparent from studying the following portion of the specification, the claims and the attached drawings.

DESCRIPTION OF THE PREFERRED EMBODIMENT

Figure 1:
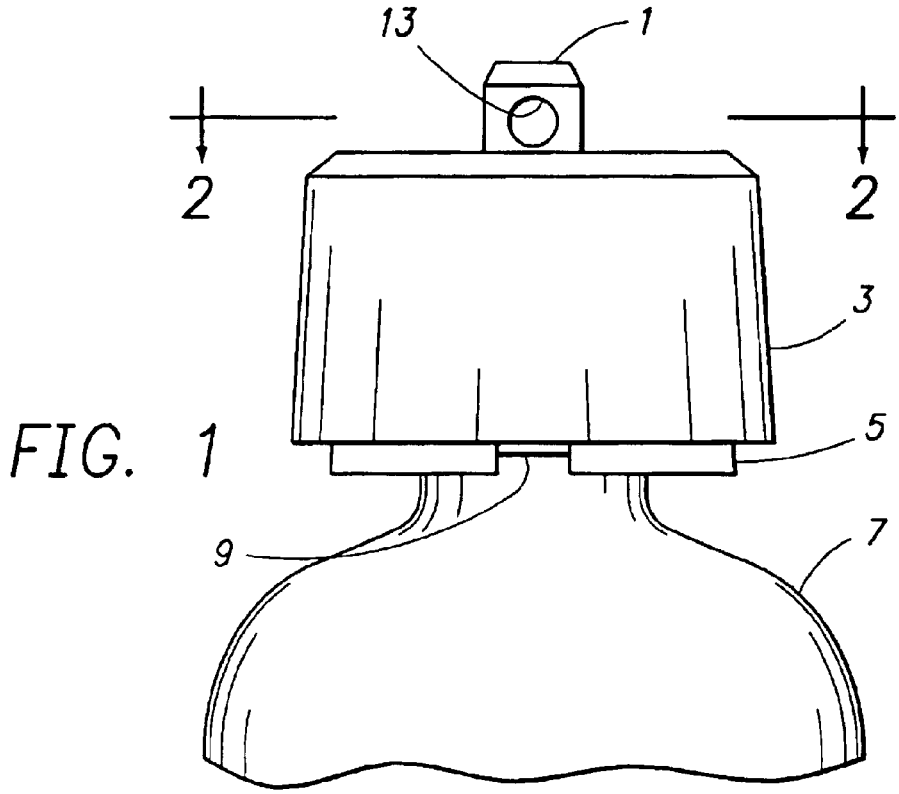
FIG. 1 is a front view of a locking ring device, according to the present invention, in place on a bottle, and ready to be secured by a lock or cable which is to be attached to a metal bolt that protrudes above the cover member.
Figure 2:
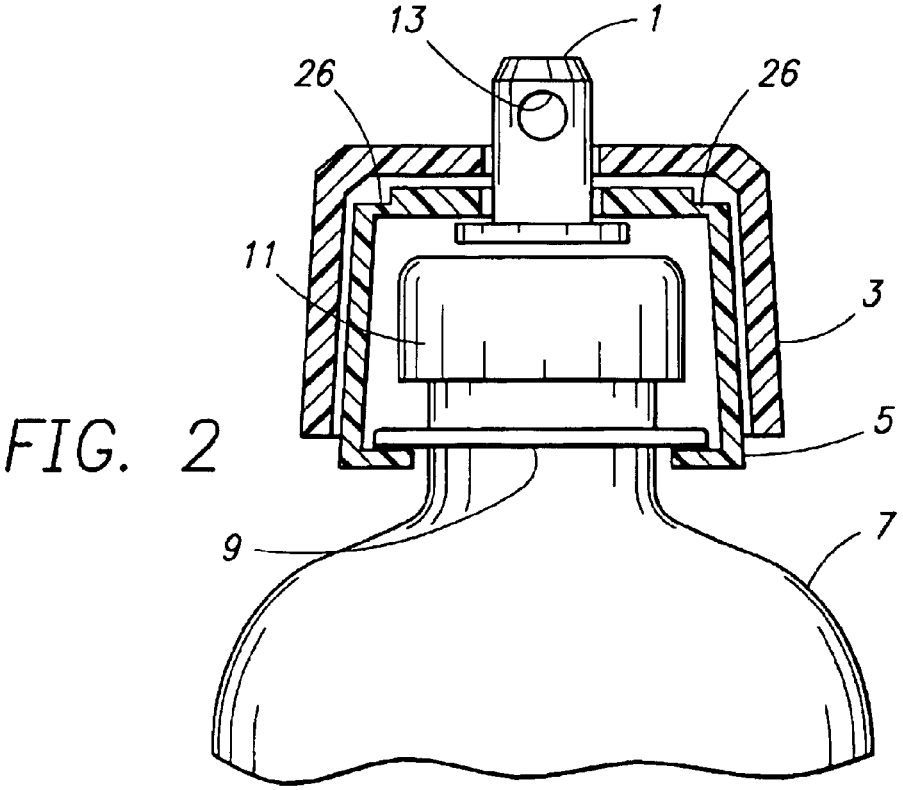
FIG. 2 is a cross-section view of the device in place over a closed cap on a bottle neck, particularly showing the device hooking on to the bottle neck ring.

Referring particularly to the drawings, there is shown in FIG. 1 a side view of a preferred embodiment of the invention locking ring device in place on a bottle 7, and ready to be secured by a securing means which is to be attached to a metal bolt 1 that protrudes above the device cover member 3. FIG. 2 is a cross section side view of the invention device in FIG. 1 taken along plane 2-2 of FIG. 1. As shown, a hinged 26 clamp member 5 is hooked under a bottle 7 neck ring 9, and is held in that position by the cover member 3 which presses radially on the hinged arms of the clamp member 5. The shaft of a metal bolt 1 passes vertically through an axial hole in the clamp member 5 and the cover member 3, and includes a through hole 13 for use in attaching a padlock or other securing means. When so secured, the device can not be removed from the bottle top and the closed bottle cap 11 can not be accessed. The clamp member 5 and its cover member 3 are sized so that there is appreciable space between the bottle cap 11 and the clamp member 5 and the bolt 1 head. Thus, a bottle cap 11 will not be rotated by rotational movement of any part of the invention locking ring device. The device comprises three parts. These are: a hinged-arm clamp member 5, a rigid, cylindrical cover member 3 and a flanged, metal bolt 1. The size of the parts is based on the size of a given container neck, its neck ring and its cap.

Several types of flanged, metal bolts may be used, two of which are illustrated and described herein. This aspect adds to the versatility of the device.

Figure 3:
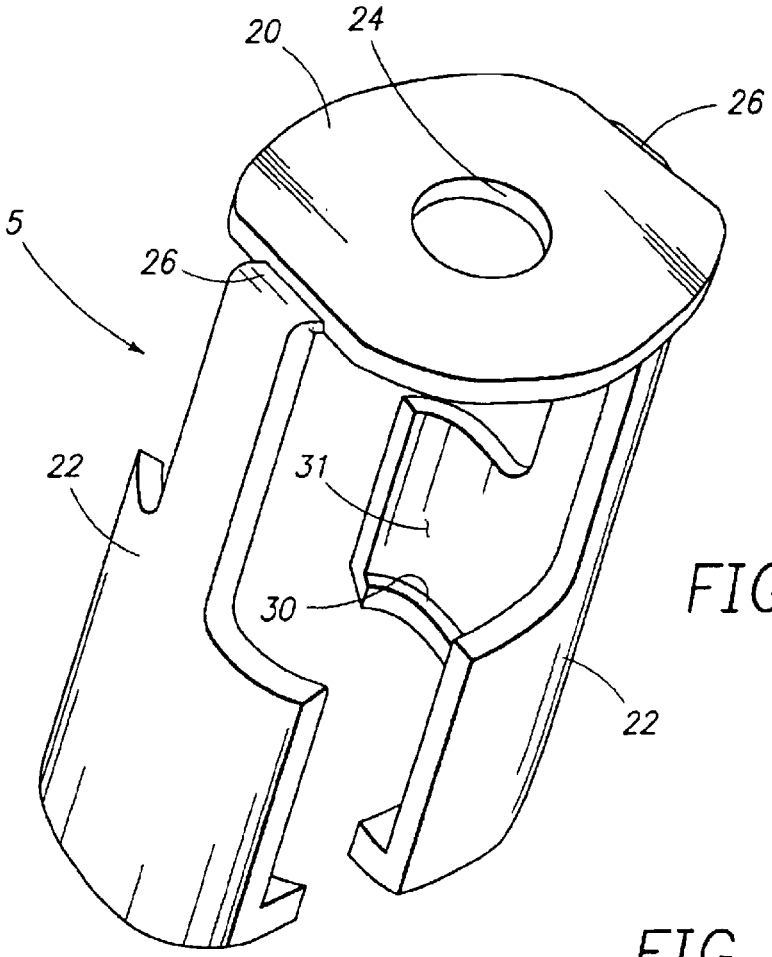
FIG. 3 is a perspective view of the device hinged clamp member for clamping on a neck ring, and shown with its hinged-end arms hanging down from the top portion and ready for clamping.
Figure 5:
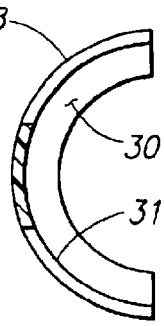
FIG. 5 is a cross-section view of the lower portion of a clamp member arm in FIG. 4, taken along plane 5-5 of FIG. 4.
Figure 4:
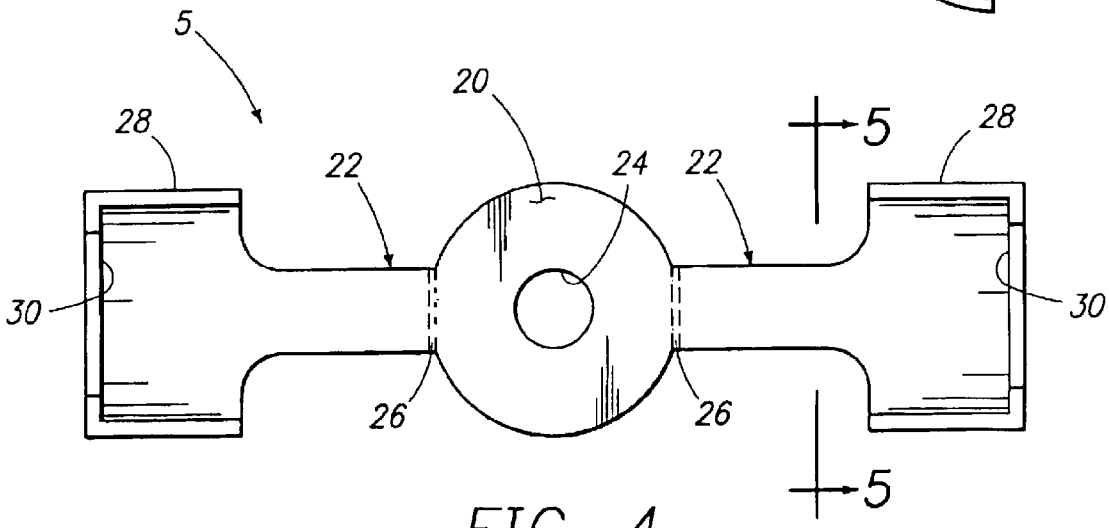
FIG. 4 is an underside plan view of the clamp member, with its arms open in the plane of the top portion surface.

Refer now to FIGS. 3, 4 and 5 which show views of the invention clamp member 5. FIG. 3 is a perspective view, particularly showing the hinged arms 22 hanging down from the top portion 20 and positioned for gripping a bottle neck. FIG. 4 is a plan underside view, with the arms 22 open in the plane of the top portion 20 surface to show full detail, while FIG. 5 is a cross-section view of an arm lower portion 28 taken along line 5-5 of FIG. 4. The two identical rigid arms 22, which are each attached to opposing edges of the clamp member top portion 20, are required to fold downwards, pivoting inwards at their attached ends until near parallel with the device vertical axis. This clamping configuration is achieved by provision of a plastic hinge 26 which is formed between the top end of each arm 22 and the top portion 20. Thus, the arms 22 can each arc downward on their flexible plastic hinge 26 until their lower extremity contacts the side of a bottle neck over which the device has been placed. Both arms 22 are identical and have a narrow, elongated upper portion which is substantially flat, and a wide, arcuately shaped lower portion 28. Included at the bottom edge of the lower portion 28 is an arcuate ledge 30 that projects inward and serves to hook on to a container neck below the neck ring when the clamp member is used. The arcuate inside surface 31 of the lower portion 28, which is curved, has a radius which is greater than a container neck ring. The ledge 30 is sized to fit partly around a container neck ring and grip the container neck when inward radial pressure is applied to the arms of the clamp member 5.

An axial first hole 24 is provided in the top portion 20 of the clamp member 5 to accommodate a bolt 1 shaft used for attaching the clamp member 5 to the device cover 3.

For the preferred clamp member as described above, the material used would necessarily be plastic. However, the equivalent gripping means as provided by the arms 22 described herein, may be achieved using two or more metal arms having the same general shape and characteristics as the preferred configuration. In this case, another form of hinge would be used to attach the arms to the top portion 20, which could be a non-metal.

Figure 6A:
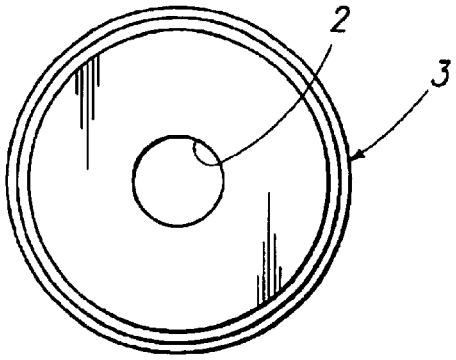
FIGS. 6A and 6B are respectively a top view and side elevation view of the device cover member.
Figure 6B:
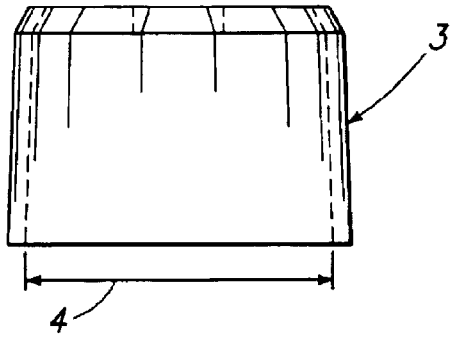

Referring now to FIGS. 6A and 6B, there is shown respectively, a top plan view and a side elevation view of the device cover member 3. The cover member 3 is generally cylindrical in shape and sized to fit snugly over a clamp member 5. The cover member 3 inside cavity diameter 4 is selected so that the cavity wall applies radial inward pressure to the arms 22 of the clamp member 5, holding the arms hard against a container neck and hooked below the container neck ring 9.

An axial second hole 2 is located in the top surface of the cover member 3 and is sized to allow passage of a bolt 1 shaft.

Figure 7A:
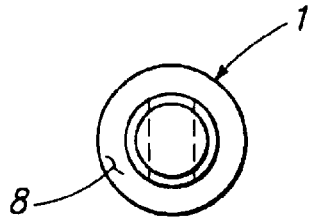
FIGS. 7A and 7B are respectively, a top view and side elevation view of a bolt for fastening the clamp member to the cover member.
Figure 7B:
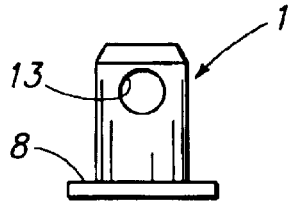

A preferred flanged, bolt 1 configuration is shown in FIGS. 7A and 7B. FIG. 7A is a plan view and FIG. 7B is a side elevation view. The bolt 1 is a metal shaft having a flange 8 attached at one end. A third hole 13 in the shaft near the shaft distal end and normal to the shaft axis, provides for attachment of a securing means such as a padlock shackle or wire rope cable. An alternate configuration to the third hole 13 is a threaded portion of the shaft, located at the shaft free distal end. For this configuration bolt, the locking means would necessarily include a matching internally threaded portion for attachment to the bolt 1.

Figure 8:
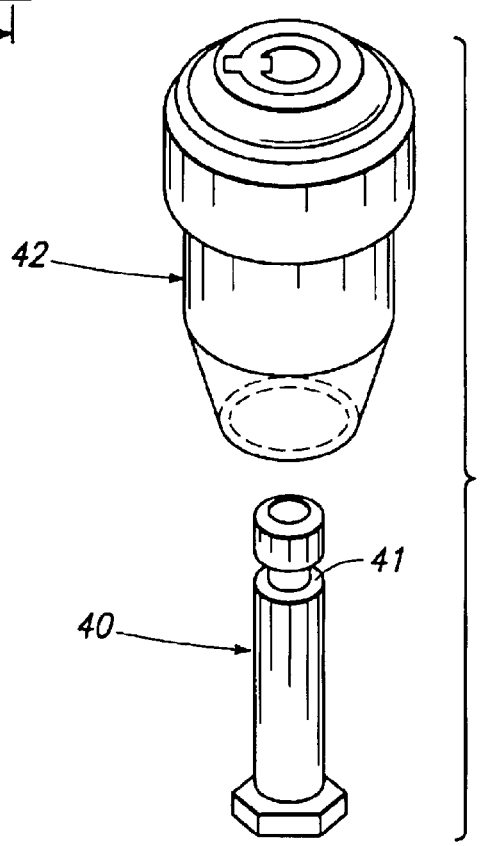
FIG. 8 shows a grooved-end bolt that is an alternative to the top fastening bolt, and a previously invented locking shaft retainer device that couples with the grooved-end bolt.

Yet another alternate configuration of a fastening bolt 40 is depicted in FIG. 8, together with its mating locking means 42. In this embodiment, a grooved-end bolt 40 is used which has a flange at one end and a deep peripheral groove 41 cut in the shaft near its distal end.

The illustrated locking means 42 is a lockable shaft retainer that is described in U.S. Pat. No. 5,992,187 which is hereby incorporated herein. For some applications, such as for medical drug storage containers, a grooved shaft and lockable shaft retainer combination might be considered preferable.

Since the invention locking ring device is applicable to portable neck-ringed medicine bottles, drug containers, liquor bottles, wine bottles etc., there is obviously a range of device sizes required to fit these applications. The relative simplicity of the device and its few parts make this requirement inexpensive to attain, given sufficient demand.

From the foregoing description, it is believed that the preferred embodiment achieves the objects of the present invention. Various modifications and changes may be made to the invention locking ring device described above which are apparent to those skilled in the art. These alternatives and modifications are considered to be within the scope of the appended claims and are embraced thereby.

Having described the invention, what is claimed is:

1. A locking ring device for use in securing a portable, necked container which includes a cap or other closure device and a neck ring, said neck ring being an outwardly extending, annular flange that is located on a container neck below the cap; said locking ring device comprising:

(a) a generally cylindrical clamp member, comprising a rigid plastic disc-shaped top portion having a diameter that is greater than the cap of said container, said top portion including an axial first hole, said first hole being sized to allow passage of a bolt shaft therein; and a gripping means for clamping to the container neck below said neck ring, said gripping means including arms that are flexibly attached to said top portion and able to hang ninety degrees to a plane defined by a top surface of said top portion;

(b) a cylindrical, rigid cover member that is sized to fit snugly over and jacketing said clamp member, said cover member including an axial second hole in a top surface, said second hole being sized to allow passage of a bolt shaft therein; and (c) a metal bolt having a shaft and a flange attached thereto at one end in a plane that is ninety degrees to the axis of said shaft; said bolt including on said shaft, means for coupling with an external securing means; said shaft of said bolt being passed through said first hole in said clamp member and through said second hole in said cover member, and said flange of said bolt abuts an underside of said top portion of said clamp member, leaving an end of said shaft protruding above said top surface of said cover member; said bolt, when passed through said top portion and said cover member as described above, causing said cover member to impart a radial force against said gripping means, causing said gripping means to clamp to said neck of said container below said neck ring, preventing access to the cap of said container; said bolt when coupled to the external securing means, preventing removal of said locking ring device.

2. The locking ring device according to claim 1, wherein said gripping means includes two identical arm members, each arm member being connected at one end, by a flexible plastic hinge to one of opposite peripheral edges of said top portion of said clamp member; said hinge, permitting said arm member to rotate through an angle of more than 90 deg.; said arm member having two portions: an elongate, narrow width, flat upper portion which is attached at one end to said hinge, and an arcuately-shaped, wide lower portion which is attached to a distal free end of said upper portion, said lower portion being attached so that an arcuate inner surface will face inwards towards a vertical axis when said arm member is rotated, said inner surface having a radius greater than the radius of a container neck, said inner surface including a matching arcuate ledge at a bottom edge, formed integrally with said lower portion and extending normal to said inner surface; said ledge being sized in width to fit under a container neck ring and abut a container neck surface when radial force is applied, pushing said arm member inwards towards a vertical axis of said clamp member.

3. The locking ring device according to claim 1, wherein said means for coupling with an external securing means, includes a third hole cut through the shaft of said bolt, ninety degrees to the shaft longitudinal axis, said third hole being sized to allow passage of a padlock shackle or a securing cable.

4. The locking ring device according to claim 1, wherein said means for coupling with an external securing means, includes a deep circumferential groove cut in the shaft of said bolt, said groove being located near to an end of said shaft, permitting said shaft to couple with a lockable shaft retainer.

5. The locking ring device according to claim 1, wherein said means for coupling with an external securing means, includes a threaded portion cut in the shaft of said bolt, for mating with a threaded socket which is attached to a securing means.

* * * * *